US007633281B2

(12) United States Patent
Sugai et al.

(10) Patent No.: US 7,633,281 B2
(45) Date of Patent: Dec. 15, 2009

(54) REFERENCE CURRENT CIRCUIT FOR ADJUSTING ITS OUTPUT CURRENT AT A LOW POWER-SUPPLY VOLTAGE

(75) Inventors: Danya Sugai, Tokyo (JP); Naoaki Sugimura, Tokyo (JP)

(73) Assignee: Oki Semiconductor Co., Ltd. (JP)

( * ) Notice: Subject to any disclaimer, the term of this patent is extended or adjusted under 35 U.S.C. 154(b) by 56 days.

(21) Appl. No.: 12/101,703

(22) Filed: Apr. 11, 2008

(65) Prior Publication Data

US 2008/0265863 A1 Oct. 30, 2008

(30) Foreign Application Priority Data

Apr. 25, 2007 (JP) ..... 2007-114951

(51) Int. Cl.
*G05F 3/16* (2006.01)

(52) U.S. Cl. ..... 323/317; 323/316

(58) Field of Classification Search ..... 323/314, 323/315, 316, 317
See application file for complete search history.

(56) References Cited

U.S. PATENT DOCUMENTS 6,172,495 B1 * 1/2001 Washburn ..... 323/316
2007/0108957 A1 5/2007 Noda

FOREIGN PATENT DOCUMENTS

JP 2000-75947 A1 3/2000

* cited by examiner

*Primary Examiner*—Shawn Riley
(74) *Attorney, Agent, or Firm*—Studebaker & Brackett PC; Donald R. Studebaker

(57) ABSTRACT

A reference current circuit includes a differential amplifier amplifying a difference in potential between a reference voltage and a first node and outputting the amplified potential difference to a second node, and adjusting transistors connected between a supply voltage and the first node. The reference current circuit further includes switches provided correspondingly to the adjusting transistors to apply a voltage of the second node to control electrodes of the adjusting transistors in response to the switches. The reference current circuit further includes a resistance connected between the first node and a common potential, and an output transistor having its conduction state responsive to the voltage of the second node for controlling a current supplied from the supply voltage to a load.

8 Claims, 6 Drawing Sheets

200

300

VCC
CON1
CON2
CON3
CON4
VA
VB
VC
VD
VE
VREF
GND
POR
IREF1
IREF2
P31
P32
N31
N32
P33
P34
R3
D1(1)
D2(n)
50
SW
R1
ADJUSTING CKT
P41
P42
R4
N41
N42
500
502
400
DIFFERENTIAL AMPLIFIER
C11
C12
C21
C22
P11
P12
P13
P14
P15
P16
P17
P18
P19
P1a
P21
P22
P23
P24
P25
P26
P27
P28
P29
P2a
N11
N12
N13
N14
N15
N16
N17
N18
N19
N21
N22
N23
N24
N25
N26
N27
N28
N29

REFERENCE CURRENT CIRCUIT FOR ADJUSTING ITS OUTPUT CURRENT AT A LOW POWER-SUPPLY VOLTAGE

BACKGROUND OF THE INVENTION

1. Field of the Invention

The present invention relates to a reference current circuit for generating a constant reference current based on a reference voltage, and more particularly to such a reference current circuit with influence of variation in its manufacturing process mitigated by means of trimming.

2. Description of the Background Art

Reference will be first be made to FIG. 3 for describing a conventional reference current circuit for better understanding a reference current according to the invention. FIG. 3 is a schematic circuit diagram. This reference current circuit is adapted to output a current Iout based on a reference voltage Vref and has a differential amplifier (AMP) 1 in which the reference voltage Vref is applied to its inverting input terminal. The differential amplifier 1 has its output terminal connected to the gate electrode of a p-channel metal-oxide semiconductor (PMOS) transistor 2. The PMOS transistor 2 has its source electrode connected to a supply voltage VDD and its drain electrode connected to a node NA which connects to ground GND via a current regulation resistance 3. The current regulation resistance 3 is provided with a plurality of regulation taps, either one of which is selected by a switch 4 so that the current regulation resistance 3 connects to the non-inverting input terminal of the differential amplifier 1. In FIG. 3, the tap selected by the switch 4 is depicted as node NB.

In the figure, reference numerals 3*a* and 3*b* denote the resistance Ra between the nodes NA and NB, and the resistance Rb between the node NB and the ground GND, respectively. These resistances 3*a* and 3*b* carry voltages Va and Vb, respectively, which have a relationship with the voltage Vds applied to the PMOS transistor 2 (which becomes a current source) as expressed by following expression (1):

$$Vds+Va+Vb=VDD \quad (1)$$

Since, in the differential amplifier 1, the feedback is effected, the output voltage is controlled such that the voltages applied to the inverting and non-inverting input terminals become equal to each other, i.e. the voltage Vb is equal to the voltage Vref. Therefore, the above expression (1) can be expressed by following expression (2):

$$VDD-V\mathrm{ref}=Vds+Va \quad (2)$$

When the amount of current passing through the PMOS transistor 2 is Iout, the voltages Vds and Va can be as expressed by following expressions (3) and (4):

$$Va=Ra\times I\mathrm{out} \quad (3)$$

$$Vb=V\mathrm{ref}=Rb\times I\mathrm{out} \quad (4)$$

Therefore, the current amount of the output current Iout, which is equal to Vref/Rb, can be decided by using the resistance value Rb which is obtained by adjusting the ratio of the resistance (Ra:Rb) to the total resistance value (Ra+Rb) of the resistance 3 as having the switch 4 selecting one of the taps of the resistance 3.

Such a conventional reference current circuit is disclosed, for example, by Japanese patent laid-open publication No. 2000-75947 and U.S. patent application publication No. 2007/0108957 A1 to Noda.

The conventional reference current circuit, however, generates a voltage Va (=Ra×Iout) by the output current Iout flowing through the adjusting resistance 3*a*. Assuming that the voltage Vds is constant, it is necessary to increase the value of right-hand side in expression (2), i.e. VDD−Vref, by the amount of the voltage Va generated across the resistance 3*a*. For this reason, it is difficult to drive the conventional reference current circuit at a low supply voltage such as VDD=about 1.2 V.

SUMMARY OF THE INVENTION

It is an object of the present invention to provide a reference current circuit having a trimming function of being able to adjust its output current easily even at a low supply voltage such as about 1.2 V.

In accordance with the present invention, the reference current circuit includes a differential amplifier for amplifying a difference in potential between a reference voltage and a first node, and outputting the amplified potential difference to a second node; a plurality of adjusting transistors connected between a supply voltage and the first node; a plurality of switches provided correspondingly to the plurality of adjusting transistors to apply a voltage of the second node to control electrodes of the adjusting transistors in response to control signals that are respectively input to the switches; a resistance connected between the first node and a common potential; and an output transistor having its conduction state responsive to the voltage of the second node for controlling a current that is supplied from the supply voltage to a load.

In the present invention, the output signal of the differential amplifier that amplifies the potential difference between the reference voltage and the first node is input to the adjusting transistors selected by the switches in response to control signals, and according to the current passing through the selected adjusting transistors, a voltage is generated at the first node. Since this renders a current-adjusting resistance unnecessary, the reference current circuit of the present invention facilitates adjusting its output current even at a low power-supply voltage.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 1:
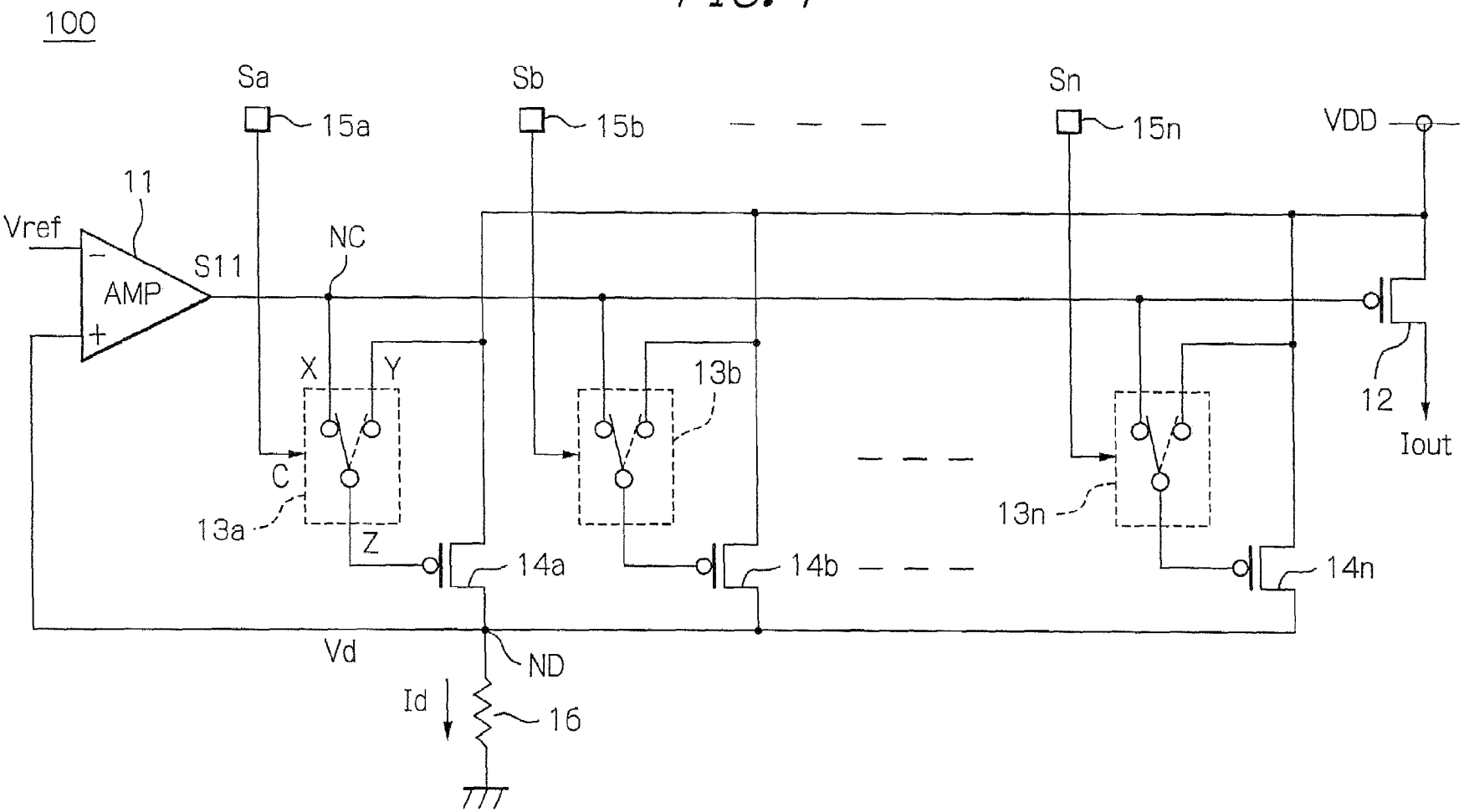
FIG. 1 is a schematic circuit diagram showing an embodiment of a reference current circuit according to the present invention.

Well, with reference to the accompanying drawings, preferred embodiments of the reference current circuit according to the present invention will be described in detail. First, a reference will be made to FIG. 1 showing in a schematic circuit diagram of an embodiment of a reference current circuit 100 according to the present invention.

The reference current circuit 100 is adapted to output a current Iout based on a reference voltage Vref, and includes a differential amplifier 11 in which the reference voltage Vref is applied to its inverting input terminal. The differential amplifier 11 is adapted to amplify the difference between the voltages applied to its two input terminals so as to output the amplified voltage, whose output terminal is connected to a node NC. The node NC is connected to the gate electrode of a p-channel metal-oxide semiconductor (PMOS) transistor 12 which outputs the current Iout according to the reference voltage Vref. The PMOS transistor 12 has its source electrode connected to a supply voltage VDD and its drain electrode connected to a load (not shown).

Figure 2:
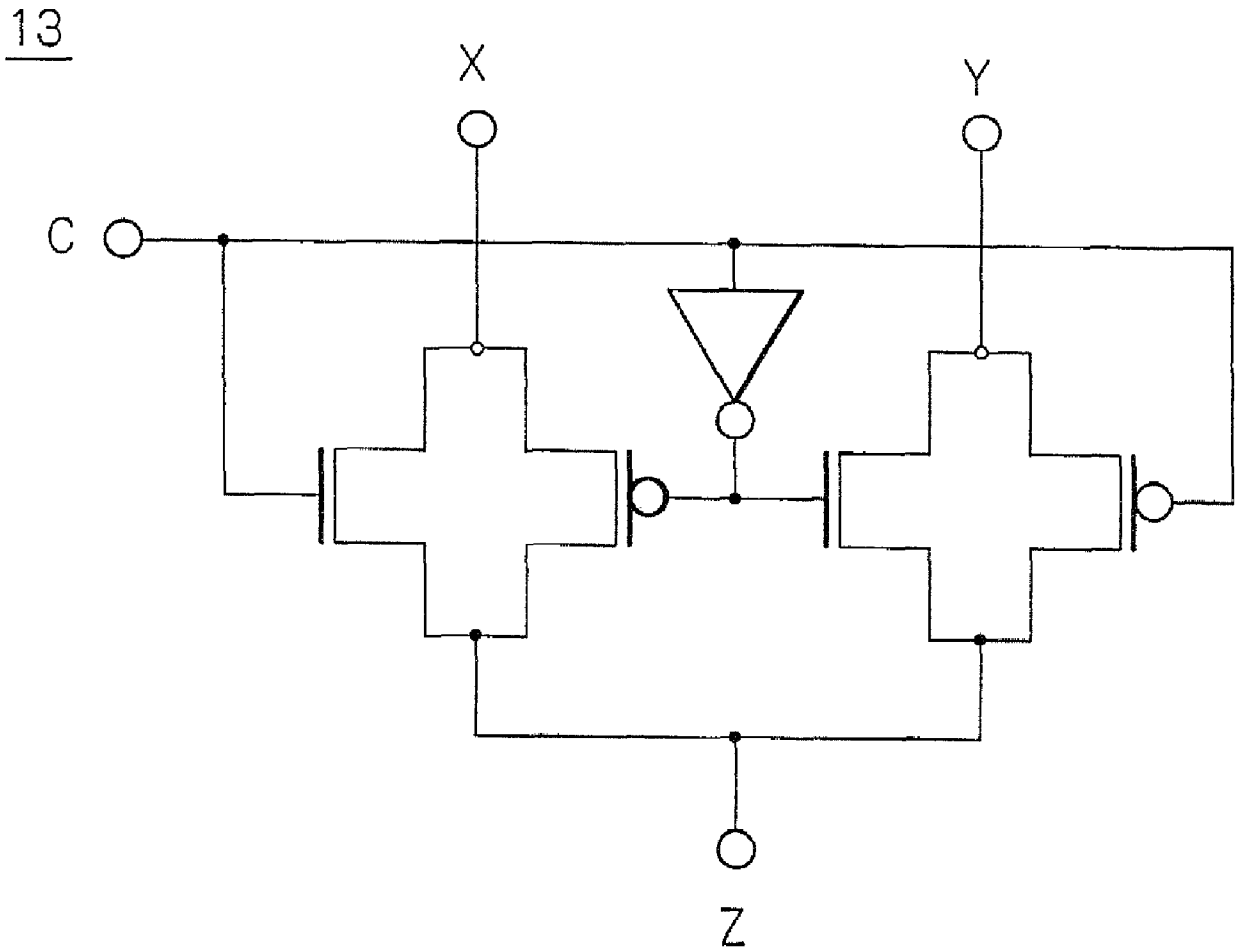
FIG. 2 is a schematic circuit diagram showing a switch in the reference current circuit shown in FIG. 1.

The node NC is further connected through switches 13*a*, 13*b*, . . . , and 13*n* to the gate electrodes of corresponding PMOS transistors 14*a*, 14*b*, . . . , and 14*n*. The switches 13*a* to 13*n* are analog switches such as shown in FIG. 2. In FIGS. 1 and 2, the switch 13 is designed to output either of two signals which are applied to its input terminals X and Y to its output terminal Z in response to a control signal applied to a control terminal C.

The switches 13*a* to 13*n* have the input terminals X and Y thereof connected in common to the node NC and supply Voltage VDD. The switches 13*a* to 13*n* also have the output terminals Z thereof connected to the gate electrodes of the corresponding PMOS transistors 14*a* to 14*n*, respectively. The switches 13*a* to 13*n* also have the control terminals C thereof connected to connector pads 15*a* to 15*n*, from which control signals Sa to Sn are fed to the control terminals C. Of course, the reference current circuit 100 shown in FIG. 1 is only illustrative and may be changed or modified, as desired. For example, the external pads 15*a* to 15*n* may be fixed to either a high or low voltage level based on adjustment results at the time of manufacture. In the description, signals may be designated with reference numerals of connections on which they are conveyed.

The PMOS transistors 14*a* to 14*n* have the source electrodes thereof connected in common to the supply voltage VDD and the drain electrodes thereof connected in common to a node ND. The node ND is connected to a reference potential, e.g. ground GND, through a resistance 16 as well as to the non-inverting input terminal of the differential amplifier 11. The dimension size, and hence current-drivability, of the PMOS transistors 14*a* to 14*n* may be the same or dissident each other. The dimension sizes may also be set such that their current-drivability satisfies a relationship of $2^0$, $2^{-1}$, $2^{-2}$, . . . $2^{-n}$, namely the relationship of minus n-th power of two, where n is a positive integer.

Note that, in the following expression, assume that at least one of the switches 13*a* to 13*n* establishes a connection between the input terminal X and output terminal Z. It is because, for example, in the reference current circuit, when switch 13*a* establishes a connection between the input terminal Y and output terminal Z in response to the control signal Sa, the gate electrode of the PMOS transistor 14*a* is connected to the supply voltage VDD and therefore the PMOS transistor 14*a* is caused to be in its off state. On the other hand, when the switch 13*a* establishes a connection between the input terminal X and output terminal Z in response to the control signal Sa, the output voltage S11 of the differential amplifier 11 is applied to the gate electrode of the PMOS transistor 14*a*.

In the differential amplifier 11, a voltage is fed back to its non-inverting input terminal through at least one PMOS transistor 13 in accordance with the output voltage S11, so that the output voltage S11 is controlled in such a manner that the inverting input terminal voltage and the non-inverting input terminal voltage become equal to each other. Therefore, the voltage at the node ND is equal to the reference voltage Vref, and the following expression (5) can be formed, $$Id=Vd/R16=V\mathrm{ref}/R16 \tag{5}$$

where Id denotes value of the current passing through the resistance 16, Vd denotes value of the voltage at the node ND and 16R denotes the resistance value of the resistance 16.

At this point, the output voltage S11 of the differential amplifier 11 is applied in common to the gate electrodes of the PMOS transistors 14*i*, where i=a to n, connected to the switches 13*i* in which an electrical connection between input terminal X and output terminal Z has been made by the control signals Si. The output voltage S11 of the differential amplifier 11 is further applied to the gate electrode of the PMOS transistor 12 which constitutes a current mirror circuit with respect to the PMOS transistors 14*i*.

Therefore, the output current Iout passing through the PMOS transistor 12 is expressed by following expressions (6):

$$I\mathrm{out}=Id\times(DIM12/DIM14)=(V\mathrm{ref}/R16)\times(DIM12/DIM14) \tag{6}$$

where DIM12 denotes the dimension size (gate width/gate length) of the PMOS transistor 12 and DIM 14 denotes sum of the dimension size of the PMOS transistors 14*i* connecting to the switches 13*i* in which the electrical connection has been made between input terminal X and output terminal Z.

More specifically, the PMOS transistors 14*i* to be connected in parallel are selected by the switches 13*i*, and the dimension size DIM14 of the sum of the current-source PMOS transistors 14*i* is adjusted, whereby an arbitrary output current Iout can be obtained and following expression (7) can be obtained, $$VDD=Vds+V\mathrm{ref} \tag{7}$$

where Vds denotes the voltage applied to the current-source PMOS transistors 14*i*.

Figure 3:
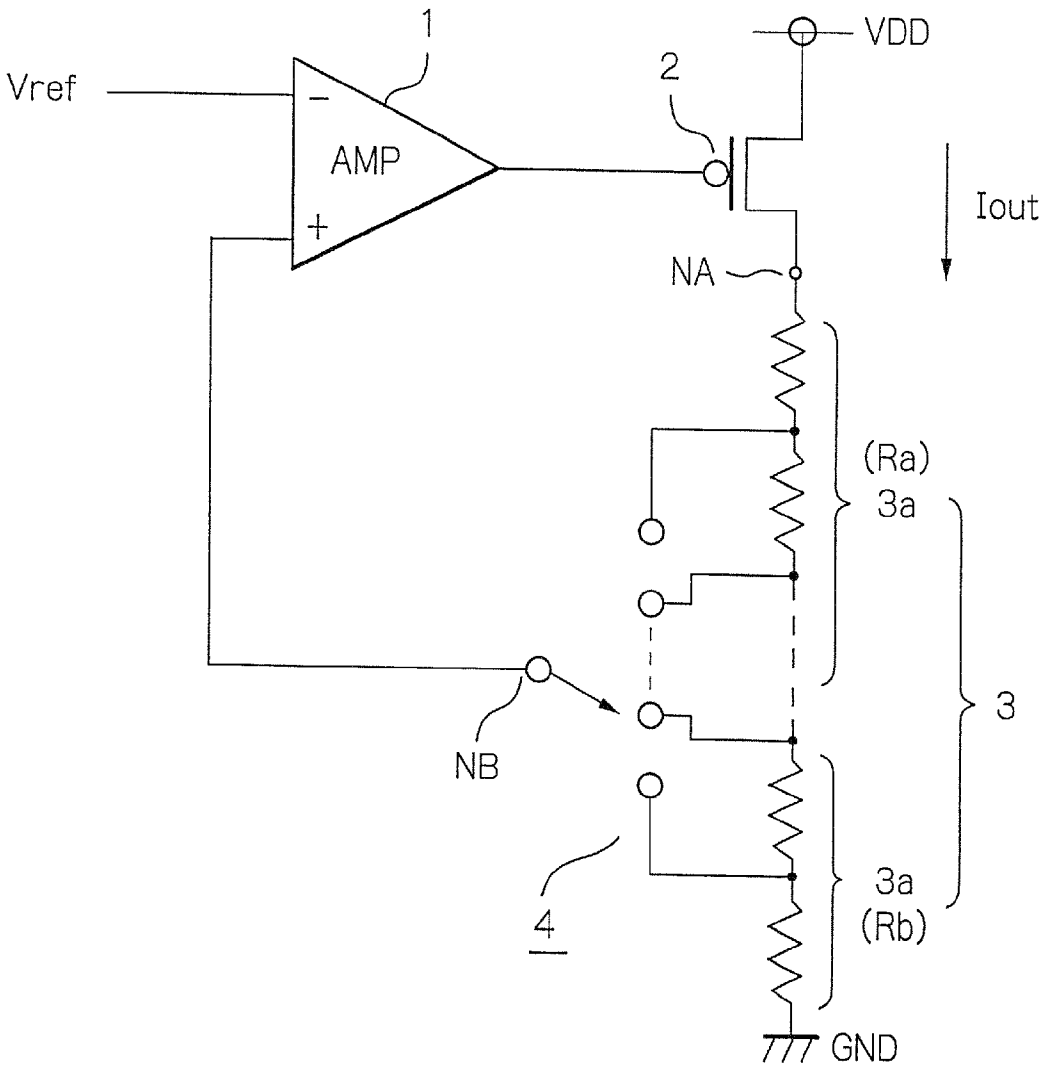
FIG. 3 PRIOR ART
FIG. 3 is a schematic circuit diagram showing a conventional reference current circuit to be compared with the reference current circuit according to the invention.

As set forth above, the reference current circuit 100 of the illustrative embodiment has the plurality of current-source PMOS transistors 14*i* and switches 13*i* for arbitrarily connecting these PMOS transistors 14*i* in parallel in response to the control signals Si, and regulates the current passing through the resistance 16 by adjusting the dimension size of the sum of the PMOS transistors 14*i* connected in parallel. Therefore, when the resistance value of the resistance 16 varies because of variations in the manufacturing process, it is possible to adjust the current passing through the resistance 16 by controlling the control signals Sa to Sn, whereby a desired current Iout can be obtained. Besides, the reference current circuit of the instant embodiment of the invention does not have a voltage drop of Va which is occurred in the conventional reference current circuit shown in FIG. 3, for example, due to the current-adjusting resistance 3*a*. The reference current circuit of the embodiment is, thus, capable of easily adjusting its output current Iout, even when the power-supply voltage VDD is as low as about 1.2 V, for example.

Figure 4:
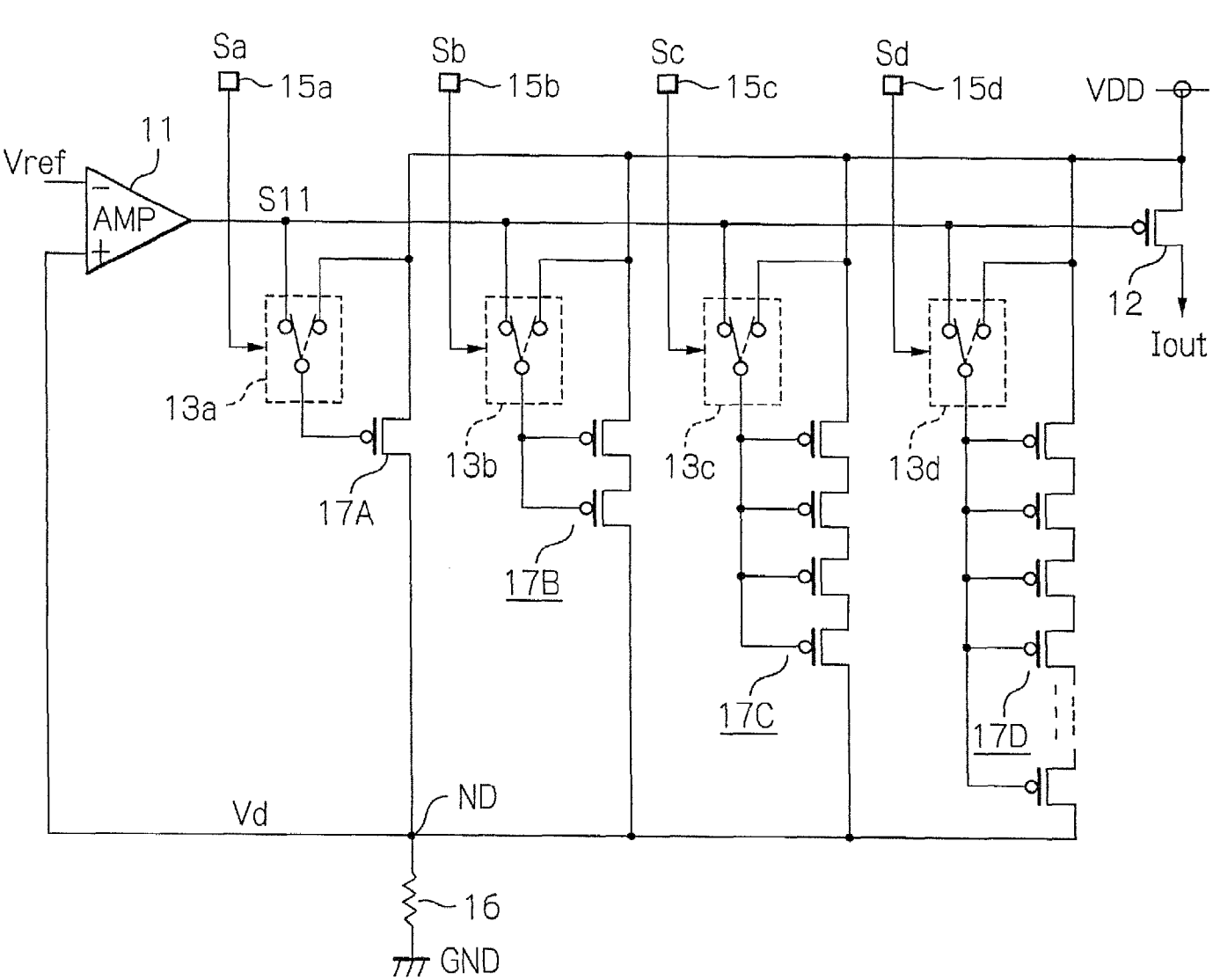
FIG. 4 is a schematic circuit diagram showing an alternative embodiment of the reference current circuit of the present invention.

Referring now to FIG. 4, there is shown an alternative embodiment of the reference current circuit 200 of the present invention. In FIG. 4, structural parts and elements like those shown in FIG. 1 are designated by identical reference numerals, and will not be described repetitively in order to avoid redundancy.

In FIG. 4, in place of the PMOS transistors 14*a* to 14*n* shown in FIG. 1, the reference current circuit 200 has PMOS transistors 17A to 17D provided with it, which are weighted in current-drivability. More specifically, the PMOS transistor 17A shown in FIG. 4 corresponds to the PMOS transistor 14*a* shown in FIG. 1 and is constituted by a single PMOS transistor. Similarly, the PMOS transistors 17B to 17*d* shown in FIG. 4 correspond to the PMOS transistors 14*b* to 14*d* shown in FIG. 1, respectively, and are constituted respectively by two, four and eight PMOS transistors connected in series. Note that, all the PMOS transistors constituting these PMOS transistors 17A to 17D may be of the same dimension size. The remainder of the reference current circuit 200 may be the same as the circuit 100 shown in FIG. 1.

In the reference current circuit 200 shown in FIG. 4, the PMOS transistors 17A to 17D are constituted by one PMOS transistor, two PMOS transistors connected in series, four PMOS transistors connected in series, and eight PMOS transistors connected in series, respectively. Consequently, the gate lengths of the PMOS transistors 17B, 17C, and 17D is two, four, and eight times the gate length of the PMOS transistors 17A, and their current-drivability becomes one-half, one-fourth, and one-eighth of the PMOS transistors 17A, respectively. Operation of this reference current circuit 200 may be the same as the illustrative embodiment shown in and described with reference to FIG. 1, except that the PMOS transistors 17A to 17D differ in current-drivability from one another.

The reference current circuit 200 has the current-source PMOS transistors 17A to 17D, which are weighted in such a manner that their current-drivability has the relationship of minus n-th power of two, where n is a positive integer as stated earlier. Therefore, the reference current circuit of the alternative embodiment, in addition to the advantages of the embodiment shown in FIG. 1, has the advantage that the range of adjustment of the output current Iout is enlarged. Further, the current-source PMOS transistors 17A to 17D may be consisted of the same size and the same characteristic PMOS transistors connected in series, so that it is possible to make accurate and fine adjustments compared with the case of employing PMOS transistors of different sizes. Note that, in the alternative embodiment, there are four adjusting PMOS transistors 17 by way of example, but the present invention is not to be limited to the four PMOS transistors.

Figure 5:
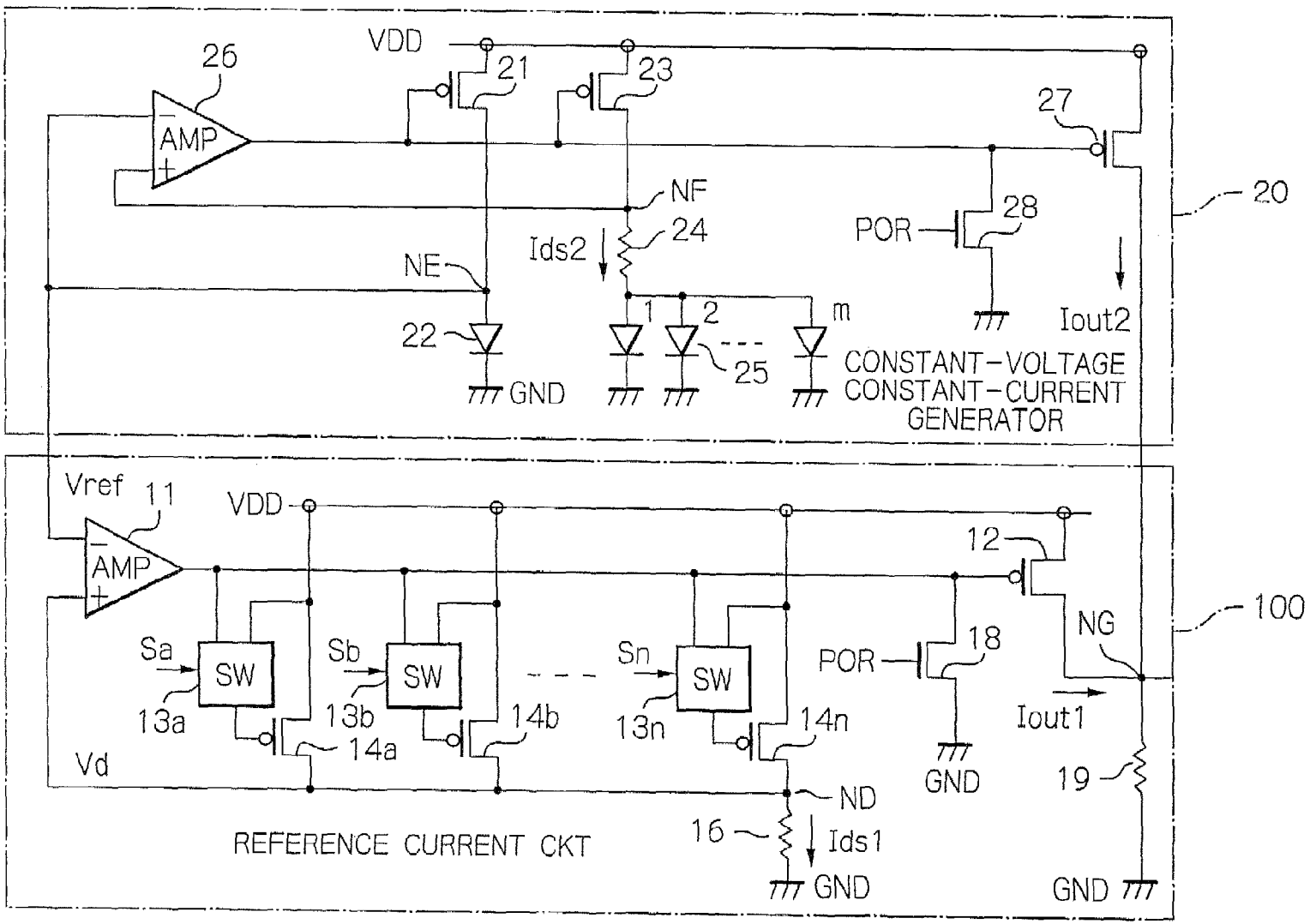
FIG. 5 is a schematic circuit diagram showing another alternative embodiment of the reference current circuit of the present invention.

Referring now to FIG. 5, there will be described another alternative embodiment of the reference current circuit 300 in accordance with the present invention. In FIG. 5, structural parts and elements like those shown in FIG. 1 are designated by identical reference numerals, and will not be described repetitively in order to avoid redundancy.

The reference current circuit 300 is constituted by adding a constant-voltage constant-current generator 20 to the reference current circuit 100 shown in FIG. 1. Note that, the constant-voltage constant-current generator 20 may be added to the reference current circuit 200.

The constant-voltage constant-current generator 20 includes a first current path in which a first current-source PMOS transistor 21 and a first diode 22 are connected in series, and a second current path in which a second current-source PMOS transistor 23 and a second diode 25 are connected in series, between a supply voltage VDD and ground GND. The second diode 25 in the second current path has a current-drivability which is m times as high as that of the first diode 22.

The constant-voltage constant-current generator 20 further includes a differential amplifier 26, which has its inverting input terminal connected to a first node NE which is the junction point between the first PMOS transistor 21 and first diode 22. The differential amplifier 26 also has its non-inverting input terminal connected to a second node NF that is the junction point between the second MPOS 23 and the second diode 24. The differential amplifier 26 has its output terminal connected to the gate electrodes of the first and second PMOS transistors 21 and 23 and the gate electrode of a current-source PMOS transistor 27.

The current-source PMOS transistor 27 is arranged such that it has its source electrode connected to the supply voltage VDD, and its drain electrode from which a constant current Iout2 is output. The PMOS transistor 27 has its drain electrode connected to the drain electrode of a PMOS transistor 12 and an output node NG that are provided in the reference current circuit 100. The constant-voltage constant-current generator 20 further includes an n-channel MOS (NMOS) transistor 28, which is connected between the gate electrode of the PMOS transistor 27 and the ground GND in order to cause starting current to flow through the PMOS transistors 21, 23, and 27 by a power-on reset signal POR at the time of starting. Likewise, the reference current circuit 100 includes an n-channel MOS (NMOS) transistor 18, which is interposed between the gate electrode of the PMOS transistor 12 and the ground GND in order to cause starting current to flow through the PMOS transistors 12 and 14*a* to 15*n* by a power-on reset signal POR at the time of starting.

In the reference current circuit 100, the output node NG is connected to a load resistance 19, through which the output current Iout flows. The output current Iout is the sum of the output current Iout1 from the reference current circuit 100 and constant current Iout2 from the constant-voltage constant-current generator 20. Further, in the reference current circuit 300, the voltage of the node NE is applied to the inverting input terminal of the differential amplifier 11 of the reference current circuit 100.

By taking all the PMOS transistors 21, 23, and 27 of the constant-voltage constant-current generator 20 to be of the same dimension size, the current Ids2 flowing through each of the PMOS transistors 21, 23, and 26 is constant and expressed as following expression (8):

$$Ids2=\{KT/q\times LN(m)\}/R24 \tag{8}$$

where K denotes the Boltzmann's constant, T denotes the ambient temperature, q denotes the electronic charge, LN(m) denotes the natural logarithm of m representing the current-carrying capacity of the diode 25, and R24 denotes the resistance value of the resistance 24.

On the other hand, in the reference current circuit 100, since the two input voltages Vref and Vd of the differential amplifier 11 are equal to each other, the voltage Vd of the node ND is equal to the forward voltage Vbe of the diode 22 of the constant-voltage constant-current generator 20. Therefore, by taking the PMOS transistors 12 and 14*a* to 14*n* of the reference current circuit 100 to be of the same dimension size, the currents flowing through these PMOS transistors can be equal to one another and the current Ids1 through the PMOS transistor 12 is given by following expression (9):

$$Ids1=Vbe/R16 \tag{9}$$

Further, since the current Iout flowing through the resistance 19 connecting between the node NG and ground GND is the sum of the currents flowing through the PMOS transistors 12 and 27, it is possible to express the current Iout by following expression (10):

$$Iout = Iout1 + Iout2 \quad (10)$$
$$= Ids1 + Ids2$$
$$= Vbe / R16 + \{KT / q \times LN(m)\} / R24$$
$$= [Vbe + (R16 / R24)\{KT / q \times LN(m)\}] / R16$$

The forward voltage Vbe of the diode 22 of the constant-voltage constant-current generator 20 is reduced with a rise in the ambient temperature T, so that it is possible to generate a constant current Iout that is independent of temperature by setting the value of R16/R24 to an appropriate value.

In the reference current circuit 300, the switches 13*a* to 13*n* of the reference current circuit 100 can be controlled by the control signals Sa to Sn so that the current flowing through the resistance 16 can be adjusted, whereby it is possible to obtain a desired output current Iout irrespective of the variations in the resistance 16 caused by the manufacturing process.

Figure 6:
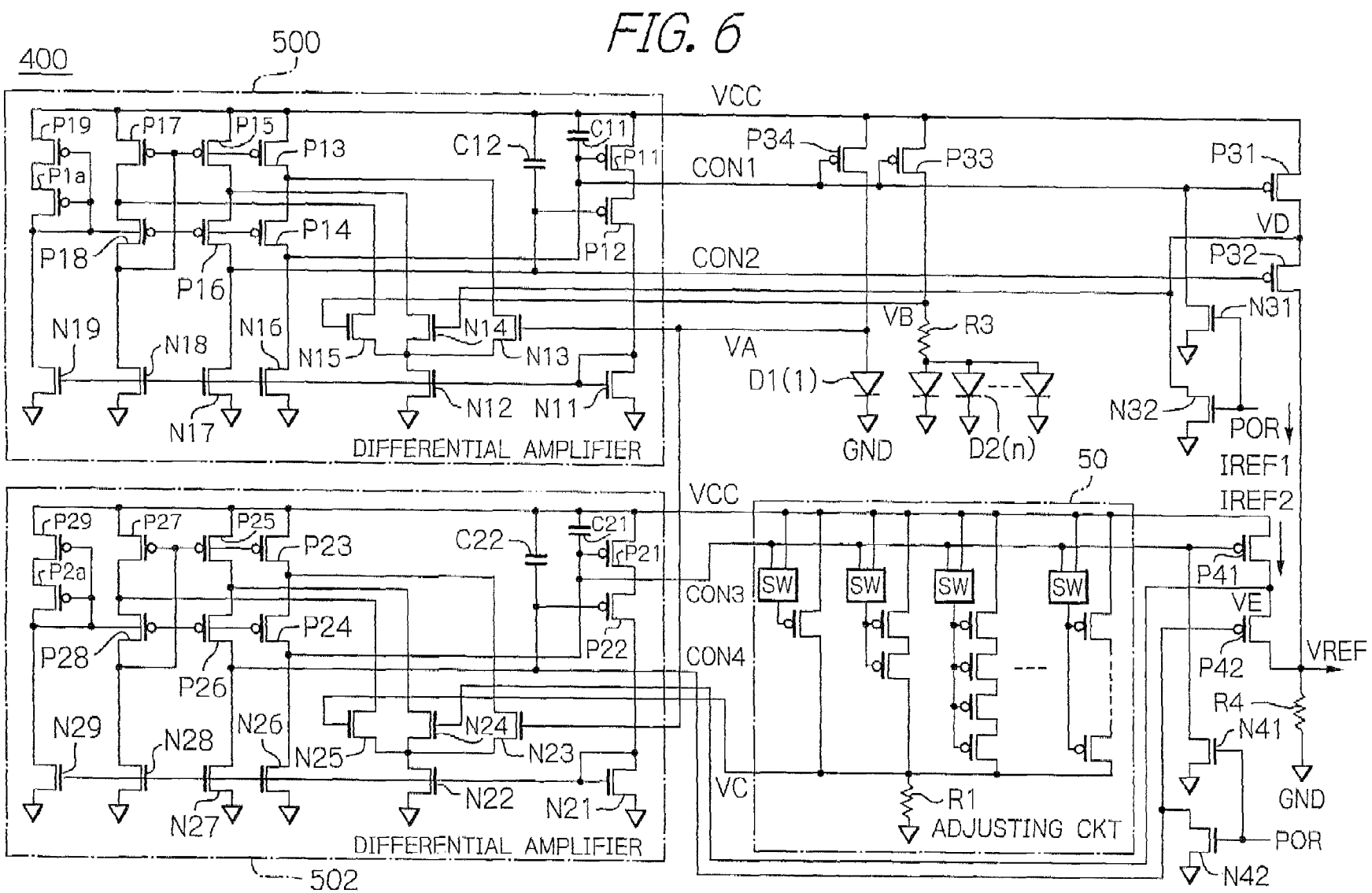
FIG. 6 is a schematic circuit diagram showing still another alternative embodiment of the reference current circuit of the present invention.

Referring now to FIG. 6, there is depicted a still other alternative embodiment of the reference current circuit in accordance with the present invention. This reference current circuit 400 is obtainable by applying to the reference current circuit shown in FIG. 5 an adjusting circuit 50 like the reference current circuit shown in FIG. 4.

This reference current circuit 400 includes, between a supply voltage VCC and ground GND, a first current path in which a current-source transistor P34 and a first diode D1 are connected in series, and a second current path in which a current-source transistor P33, a resistance R3, and a second diode D2, whose current-carrying capacity is n times as much as that of the first diode D1, are connected in series. From the junction point the current-source transistor P34 and the diode D1 in the first current path, a first voltage VA is output, and from the junction point the current-source transistor P33 and the resistance R3 in the second current path, a second voltage VB is output. The reference current circuit 400 further includes a third current path in which current-source transistors P31 and P32 are connected in series, in which a third voltage VD is output from the junction point between the current-source transistors P31 and P32.

The three voltages VA, VB, and VD are applied to a first three-input two-output differential amplifier 500, from which first and second control signals CON1 and COM2 are output, respectively. In response to the first control signal CON1, the current-source transistors P31, P33, and P34 are driven in common so that the voltages VA and VB hold the same voltage. Further, in response to the second control signal CON2, the current-source transistor P32 is driven so that the voltages VB and VD hold the same voltage, whereby the current-source transistor P32 generates a first constant current IREF1 that is proportional to the thermal voltage.

The reference current circuit 400 further includes, between the supply voltage VCC and ground GND, a fourth current path that is formed by the adjusting circuit 50 of the same configuration as the reference current circuit shown in FIG. 4, which generates a voltage VC through a resistance R1; and a fifth current path in which current-source transistors P41 and P42 are connected in series and a voltage VE is output from the junction point between them.

The three voltages VA, VC, and VE are applied to a second three-input two-output differential amplifier 502, from which third and fourth control signals CON3 and COM4 are output, respectively. In response to the third control signal CON3, the current-source transistors and current-source transistor P41 of the adjusting circuit 50 are driven in common so that the voltages VA and VC hold the same voltage. Moreover, in response to the fourth control signal CON4, the current-source transistor P42 is driven so that the voltages VC and VE hold the same voltage, whereby this current-source transistor P42 generates a second constant current IREF2 that is proportional to the thermal voltage.

The two constant currents IREF1 and IREF2 flow through a common resistance R4 to the ground GND, and the voltage generated by this resistance R4 is output as the reference voltage VREF.

Since the first and second differential amplifiers 500 and 502 may substantially be the same in construction and operation, a detailed description will be given of the first differential amplifier 500.

The differential amplifier 500 includes transistors (differential input units) N13, N14, and N15 in which the voltages VA, VD, and VB are respectively applied to their gate electrodes. These transistors N13 to N15 have the source electrodes thereof connected to ground GND via a transistor N12, and the drain electrodes thereof connected to a supply voltage VCC via transistors P13, P15, and P17, respectively.

The transistor P13 also has its drain electrode connected to the ground GND through transistors P14 and N16 connected in series. Likewise, the transistor P15 has its drain electrode connected to the ground GND through transistors P16 and N17 connected in series, and the transistor P17 has its drain electrode connected to the ground GND through transistors P18 and N10 connected in series. From the junction point between the transistors P14 and N16, the first control signal CON1 is output, and the second control signal CON2 is output from the junction point between the transistors P16 and N17. In order to stabilize the operation of the first and second control signal CON1 and CON2, there is provided first and second capacitor C11 and C12, respectively, between the supply voltage VCC and each of the drain electrodes of the transistors P14 and P16, respectively.

The differential amplifier 500 further includes a first series circuit which has transistors P11, P12, and N11 connected between the supply voltage VCC and ground GND; and a second series circuit which has transistors P19, P1*a*, and N19 connected between the supply voltage VCC and the ground GND. The previously-described control signals CON1 and CON2 are input to the gate electrodes of the transistors P11 and P12, respectively. The transistor N11 also has its drain electrode connected in common to the gate electrodes of the transistors N11, N12, N16, N17, N18, and N19.

The transistors P14, P16, P18, P19, and P1*a* have the gate electrodes thereof connected in common to the drain electrode of the transistor N19. The transistors P13, P15, and P17 have the gate electrodes thereof connected in common to the drain electrode of the transistor N18.

The reference current circuit 400 of the present alternative embodiment operates in the substantially same manner as the reference current circuit 300 and is particularly suitable for a low-voltage operation.

The entire disclosure of Japanese patent application No. 2007-114951 filed on Apr. 25, 2007, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A reference current circuit comprising:

a differential amplifier for amplifying a difference in potential between a reference voltage and a first node, and outputting an amplified potential difference to a second node;

a plurality of adjusting transistors connected between a supply voltage and said first node;

a plurality of switches provided correspondingly to said plurality of adjusting transistors for applying a voltage of said second node to control electrodes of said adjusting transistors in response to control signals that are respectively input to said switches;

a resistance connected between said first node and a common potential; and an output transistor having a conduction state responsive to the voltage of said second node for controlling a current that is supplied from the supply voltage to a load.

2. The reference current circuit in accordance with claim 1, wherein said plurality of adjusting transistors have dimension sizes different from each other so that each of said plurality of adjusting transistors has current-drivability satisfying a relationship of minus n-th power of two, among said plurality of adjusting transistors, where n is a positive integer.

3. The reference current circuit in accordance with claim 1, wherein said plurality of adjusting transistors are of a same size as each other and form serial connections which are different in number of said transistors from each other.

4. The reference current circuit in accordance with claim 3, wherein the serial connections are different in number of said transistors from each other in a relationship of n-th power of two, where n is a positive integer.

5. A reference current circuit comprising:

a first differential amplifier for amplifying a difference in potential between a reference voltage and a first node, and outputting an amplified potential difference to a second node;

a plurality of adjusting transistors connected between a supply voltage and said first node;

a plurality of switches provided correspondingly to said plurality of adjusting transistors for applying a voltage of said second node to control electrodes of said adjusting transistors in response to control signals that are respectively input to said switches;

a first resistance connected between said first node and a common potential;

a first output transistor having a conduction state responsive to the voltage of said second node for controlling a first current that is supplied from the supply voltage to an output node;

a second differential amplifier for amplifying a difference in potential between the reference voltage and a third node, and outputting an amplified potential difference to a fourth node;

a first control transistor connected between the supply voltage and a fifth node to which the reference voltage is output, and having a conduction state responsive to a voltage of said fourth node;

a first diode connected between said fifth node and the common potential;

a second control transistor connected between the supply voltage and said third node, and having a conduction state responsive to the voltage of said fourth node;

a second resistance connected between said third node and a sixth node;

a second diode connected between said sixth node and the common potential, and having current-carrying capacity higher than said first diode; and a second output transistor having a conduction state responsive to the voltage of said fourth node for controlling a second current that is supplied from the supply voltage to said output node.

6. The reference current circuit in accordance with claim 5, wherein said plurality of adjusting transistors have dimension sizes different from each other so that each of said plurality of adjusting transistors has current-drivability satisfying a relationship of minus n-th power of two, among said plurality of adjusting transistors, where n is a positive integer.

7. The reference current circuit in accordance with claim 5, wherein said plurality of adjusting transistors are of a same size as each other and form serial connections which are different in number of said transistors from each other.

8. The reference current circuit in accordance with claim 7, wherein the serial connections are different in number of said transistors from each other in a relationship of n-th power of two, where n is a positive integer.

* * * * *